US010618792B1

(12) United States Patent
Xin

(10) Patent No.: US 10,618,792 B1
(45) Date of Patent: Apr. 14, 2020

(54) FOUNTAIN CUP

(71) Applicant: Alfred Xueliang Xin, Cincinnati, OH (US)

(72) Inventor: Alfred Xueliang Xin, Cincinnati, OH (US)

( * ) Notice: Subject to any disclaimer, the term of this patent is extended or adjusted under 35 U.S.C. 154(b) by 0 days.

(21) Appl. No.: 16/234,663

(22) Filed: Dec. 28, 2018

Related U.S. Application Data

(63) Continuation-in-part of application No. 16/190,095, filed on Nov. 13, 2018, now abandoned.

(51) Int. Cl.
*A47G 19/22* (2006.01)
*B67D 1/00* (2006.01)

(52) U.S. Cl.
CPC .... *B67D 1/0004* (2013.01); *B67D 2001/0097* (2013.01)

(58) Field of Classification Search
CPC ..... A47G 19/2272; B67D 2001/0097
See application file for complete search history.

(56) References Cited

U.S. PATENT DOCUMENTS 5,085,336 A * 2/1992 Lynd ..... B65D 47/32 220/254.3
8,668,106 B1 * 3/2014 Joy ..... A47G 19/2266 220/254.3
9,010,953 B1 * 4/2015 Wells ..... F21V 33/0056 362/101
9,346,607 B2 * 5/2016 Madjar ..... B65D 83/00
9,636,697 B1 * 5/2017 Jih ..... B05B 17/08
2006/0226110 A1 * 10/2006 Choi ..... A47G 19/2266 215/228
2010/0059515 A1 * 3/2010 Wilkerson ..... A47G 19/2227 220/260
2014/0299614 A1 * 10/2014 Mithal ..... B65D 43/0212 220/713
2017/0363260 A1 * 12/2017 Li ..... F21S 9/02
2019/0021530 A1 * 1/2019 Liu ..... A47G 19/2272
2019/0029448 A1 * 1/2019 LaGarde ..... A47G 19/2272
2019/0053649 A1 * 2/2019 Novak ..... A47G 19/2272

* cited by examiner

*Primary Examiner* — J C Jacyna

(57) ABSTRACT

A fountain water cup is invented to allow users of the cup to drink water or other fluid drinks without having to physically touch the cup with month.

5 Claims, 7 Drawing Sheets

FOUNTAIN CUP

This application is a continuation-in-part of and claims the benefit of U.S. patent application Ser. No. 16/190,095, the entireties of which are incorporated herein by reference.

FIELD OF THE INVENTION

The present invention relates generally to drinking cup, more specifically but not by way of limitation, the invented cup enables user of the cup to drink water or any liquid drinks without having to physically touch the cup with mouth.

BACKGROUND

Drinking cups are used by people in daily life, and cups with lid are usually used by people when driving, walking or carrying the cup around. When we drink water from the lid with an opening or with a straw, bacteria and germs may build up and quickly generate millions of more. When drinkers have to share the same cup, germs and virus are transmitted from one person to another.

Therefore there is a need to invent a cup that users may drink from the cup without having to touch the cup with mouth physically.

SUMMARY OF THE INVENTION

It is the object of the present invention to provide a drinking cup allowing users to drink water or liquid drinks without having to touch the cup with mouth.

Another object of the present invention is to prevent germs and virus transmitting among users of the cup when a drink is shared by users.

In order to do so, a fountain water cup is provided, comprising a cup in a plurality of hollow-cylindering shapes with an opening at top and a closed end at bottom; a lid removably coupled to the opening of the cup at top, with a water ejection pipe extended above its surface, and having a water retaining compartment with small openings served as water inlets on upper surface of the lid to trap spilled water, and an opening coupled to a removable cover on upper surface served as water outlet to release water retained in the water retaining compartment; a compartment with small openings served as water inlets on its upper surface is located at the lower end of the cup housing a water ejector pump; batteries are installed within another compartment located at the bottom end of the cup; an electrical switch is located on outer wall of the cup and wired to switch on and off connections between the batteries and the water ejector pump; the wall of the cup may have an outer wall and an inner wall with a space in between and served as an insulator to retain temperature of the fluid inside the cup; a pipe is configured with water ejection outlet of the water ejector pump and extended from the compartment housing the pump through the interior of the cup and further connecting to the pipe within the lid with connectors. The connector with the section of the pipe within the lid is slightly larger in diameter than the connector with the section of the pipe extended through the cup, and a small space between connectors is served as an air inflow, when the ejector pump stops working the section of the pipe within the lid functions as an air inflow duct.

When a user turn on switch, the battery powered water ejector pump starts to operate and ejects water out from the cup through the opening of the pipe; when in use the compartment within the cover lid is served as a water retainer housing spilled water.

Optionally a multi-directional water nozzle may be installed at the opening of the pipe, which enables users to adjust their preferred water ejection angle.

Further an optional power receiving device connected to the battery is installed in the second compartment, the power receiving device is configured to receive electrical power from an electrical power supplying device.

Still further an optional electronic monitoring device is installed, the electronic monitoring device includes an electronic processor installed in the second compartment, a sensor installed in the first compartment; the electronic processor is further configured with electrical wirings connecting the switch and the ejector pump; the electronic processor is configured to receive temperature data of the fluid from the sensor when user presses the switch; and activate the ejector pump if the temperature of the fluid is within a temperature range suitable for drinking with month; the electronic processor is also configured to receive the fluid status data from the sensor when presses the switch; and activate the ejector pump if there is fluid in the cup; an electronic display panel installed on the outer wall of the cup, the electronic display panel is configured with the electronic processor and to display a message when the fluid is beyond the temperature range or no fluid is in the cup, and under such conditions the ejector pump shall not be activated.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
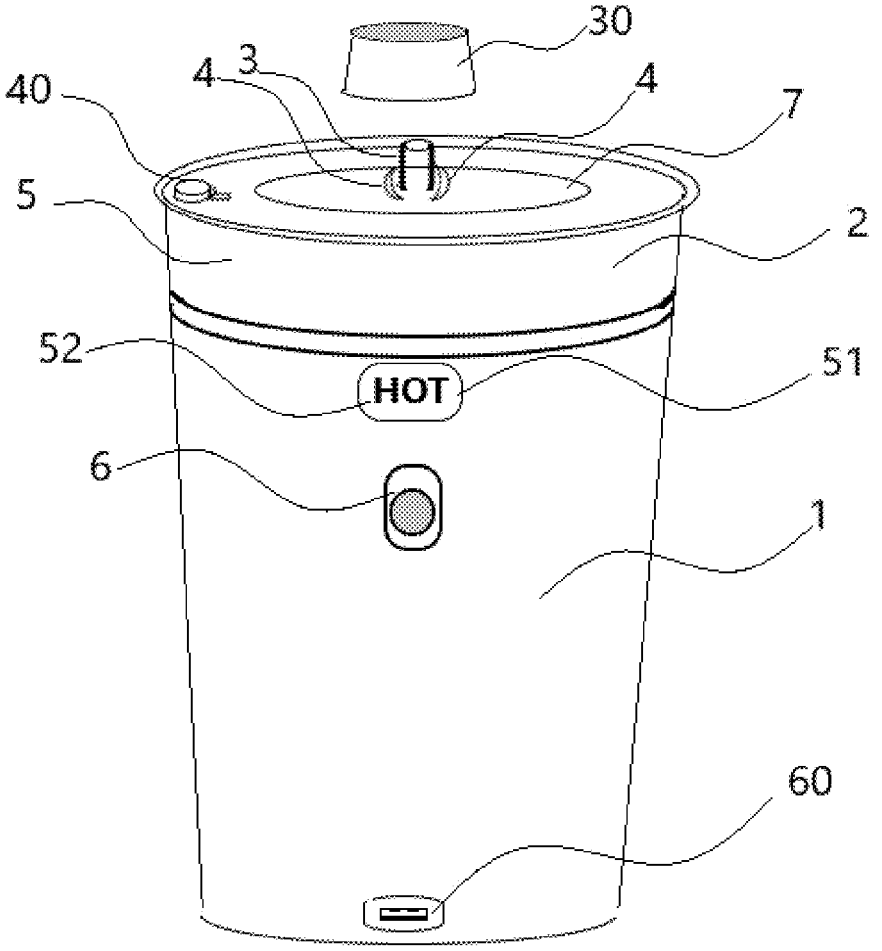
FIG. 1 illustrates the appearance of a fountain water cup.

Referring now to the drawings submitted herewith, wherein various elements depicted therein are not necessarily drawn to scale and wherein through the views and figures like elements are referenced with identical reference numerals, there is illustrated a configuration of an embodiment according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element or a part" is a reference to one or more elements and parts, and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Figure 2A:
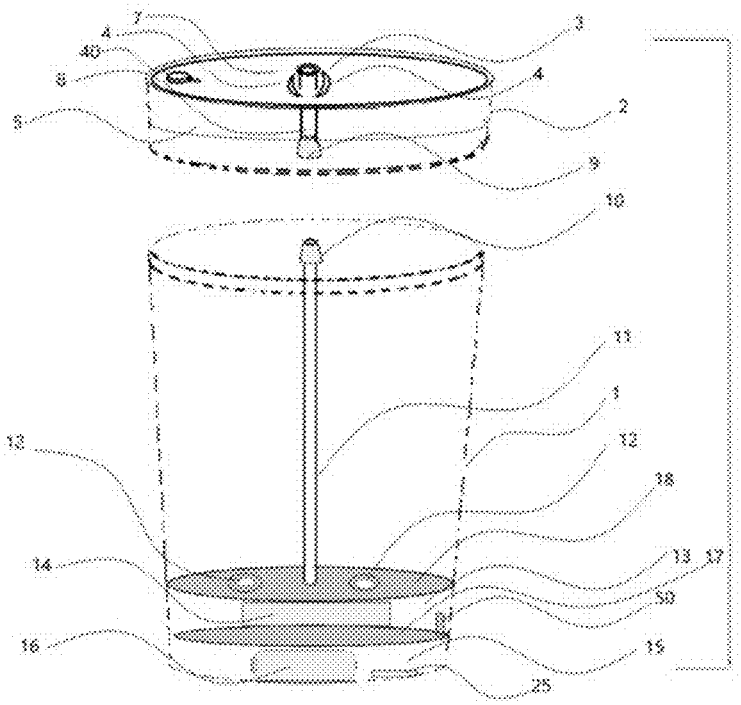
FIGS. 2A and 2B illustrate the interior structure of the invented electrical fountain cup and double wall structure.
Figure 2B:
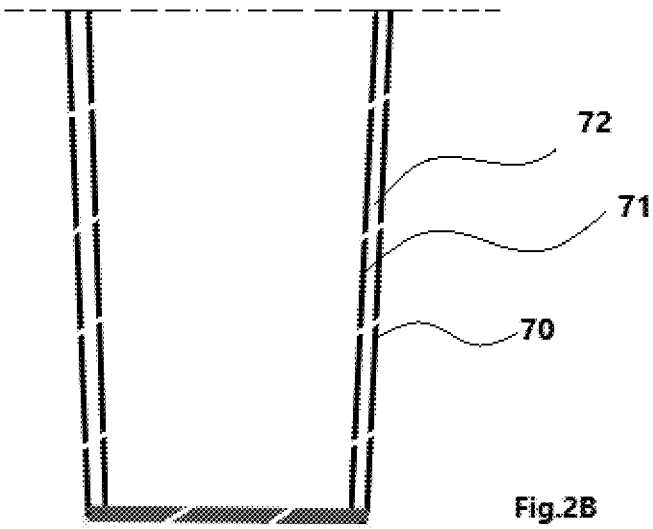
Figure 4:
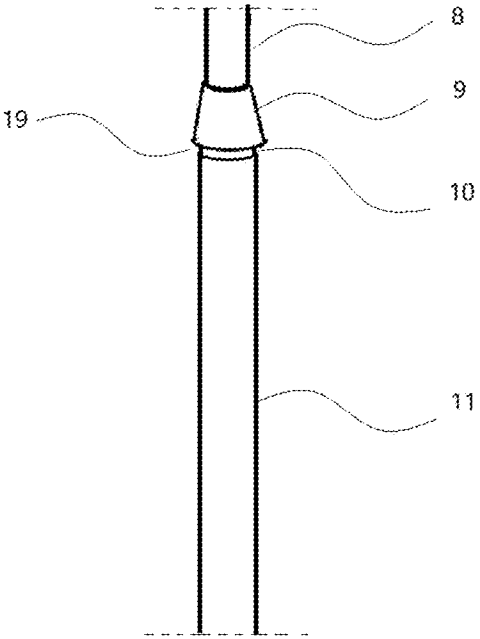
FIG. 4 illustrates two parts of the water ejection pipe connected to together with a connector on each end of the pipe.
Figure 3:
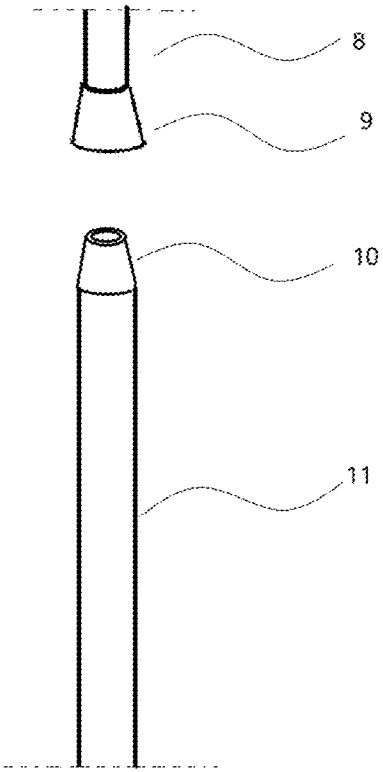
FIG. 3 is a illustrates the two parts of the water ejection pipe not connected together when the cover lid is not put in position to cover the cup.
Figure 5:
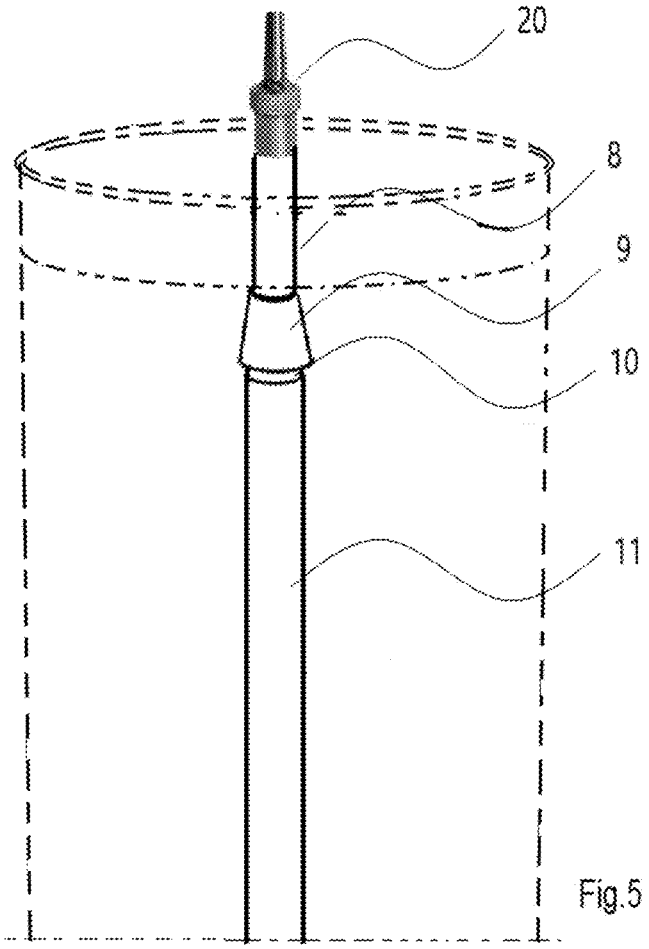
FIG. 5 illustrates a multi-directional water nozzle is installed to the opening of the water ejection pipe.
Figure 7:
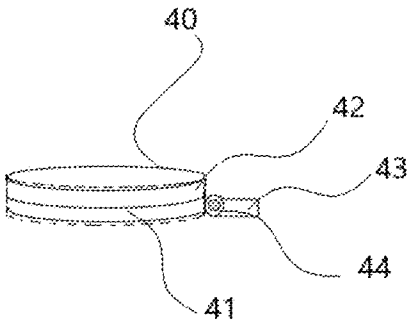
FIG. 7 illustrates structure and functions of second cover cap.
Figure 6:
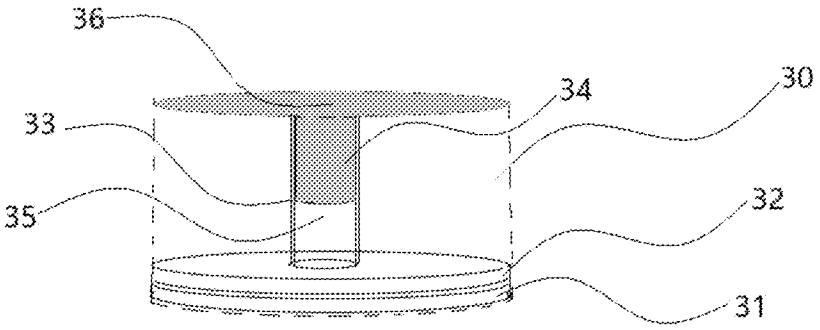
FIG. 6 illustrates structure and functions of a first cover cap.
Figure 8:
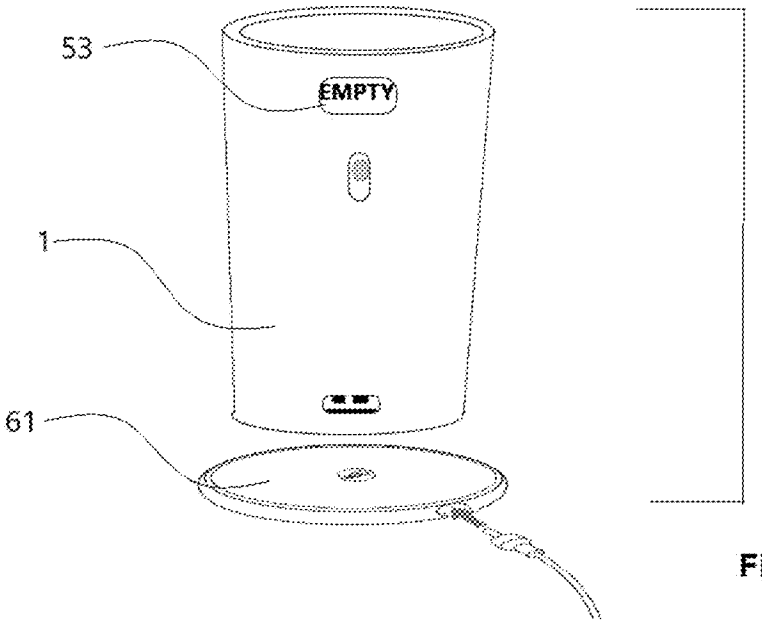
FIG. 8 illustrates an electrical charging configuration.
Figure 9:
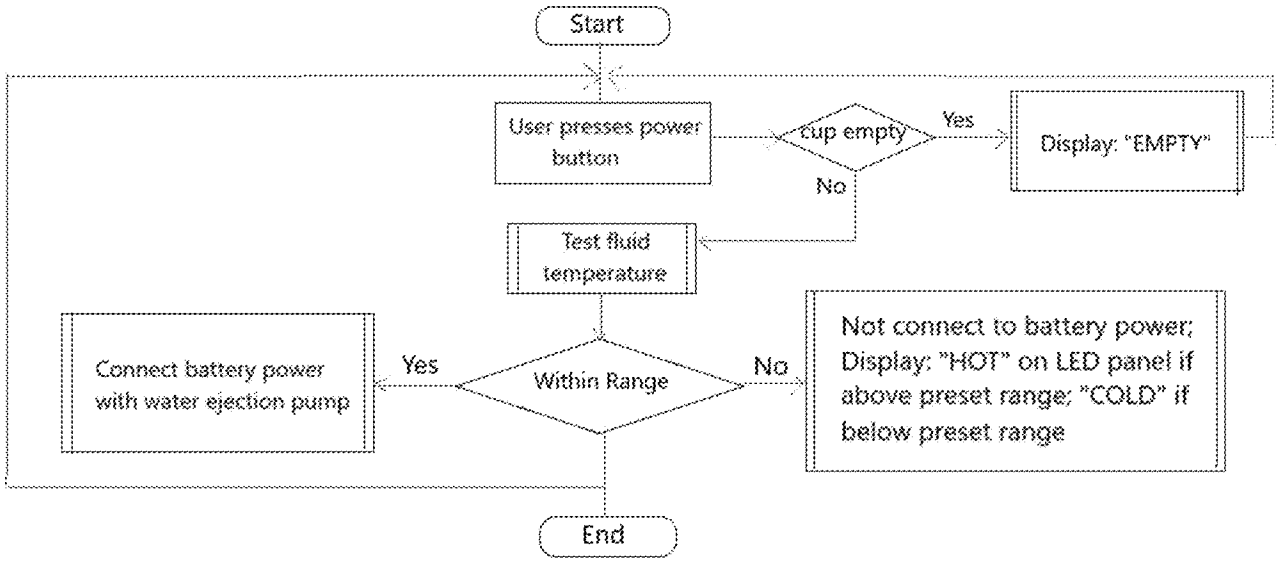
FIG. 9 illustrates a flowchart showing operational logics of the electronic monitoring device.

Referring in particular to FIGS. 1-9, a preferred embodiment of the present invention that a fountain water cup 1 in a plurality of hollow-cylindering shapes with an opening at top and a closed end at bottom. A lid 2 removably coupled to the opening of the cup at the top with a water ejection pipe 8 extended above its top surface 3 and having a water retaining compartment 5 with small openings 4 as water inlets in a lower surface area 7 within upper surface to trap spilled water.

A compartment 13 separated by a sheet of material 18 with small openings 12 served as water inlets on its upper surface is located at the lower end of the cup housing a water ejector pump 14. Batteries 16 are installed within another compartment 15 separated and sealed by another sheet of material 17 located immediately beneath the compartment housing the water ejector pump and at the bottom end of the cup. An electrical switch with push button 6 is located on outer wall of the cup and wired to switch on and off the connection between the batteries and the water ejector pump.

In one embodiment, the wall of the cup may have an outer wall 70 and an inner wall 71 with a space 72 in between for temperature insulation, and optionally insulation materials may be stuffed within the space 72 serving to retain temperature of the water or fluids inside the cup.

A pipe 11 that is configured with a water ejection outlet 3 of the water ejector pump, wherein the pipe extends from compartment 13 through the interior of the cup and further extended to the outside of the lid with an opening. Two sections of the pipe (8 and 11) are connected by connectors (9 and 10) once the lid covers the opening end of the cup.

Connector 9 is slightly bigger in diameter than connector 10, preserving a small space 19 between connectors (9 and 10), When the lid covers the opening end of the cup.

When user stops drinking, the section of the water ejection pipe 8 installed on the lid acts as air inflow duct, and allows air flow in from the space between the connectors 19 to fill the vacuum in the interior of the cup generated from outflow of water. Since users will have one sip after another, such mechanical arrangement for air inflow is adequate and sufficient.

A removable cover cap 30 coupled to the lid, the removable cover cap has a pad 31 made of elastic materials, such as rubber, with magnetic pad 32 next to it covering water ejection opening 3 and water inlets 4; a hollow cylinder 33 is located within closed end 36 of the cover cap, and filled with elastic materials at upper portion of the cylinder 34 and the lower portion 35 housing the water ejection outlet which is closely sealed by the elastic materials 34 when the cover cap is magnetically attached to the metal part of the lid.

A water outlet opening coupled to a removable cover cap 40 connected to the lid 2 with a hinge (43 and 44) has a pad 41 made of elastic materials, such as rubber, covering the water outlet opening, and with a magnetic pad 42 next to it; when in closed position the cover cap magnetically attached to the metal part of the lid closely seals the water outlet opening; user may open the cover cap 40 to release water retained in the compartment.

In one embodiment, an optional multi-directional water nozzle 20 may be installed at the opening of the pipe, which enables users to adjust their preferred water ejection angle.

When a user pushes with a finger to turn on the switch, the battery powered water ejector pump starts to operate and ejects water out from the cup through the opening of the pipe.

In one embodiment, an optional sensor installed on the cup may be configured to activate the water ejector pump when user is close enough and within the reach of the jet of water, in proximity to the water ejection outlet.

When user drinks water, the compartment 5 within the lid is configured to retain spilled water.

Still in another embodiment an optional power receiving device (60-61) connected to the battery is installed in the second compartment, the power receiving device is configured to receive electrical power from a wired or wireless electrical power transferring device via wired 60 or wireless 61 connections.

Still further in another embodiment an optional electronic monitoring device is installed, the electronic monitoring device includes an electronic processor 25 installed in the second compartment, a sensor 50 installed in the first compartment; the electronic processor is further configured with electrical wirings connecting the switch 6 and the ejector pump 14; the electronic processor is configured to receive temperature data of the fluid from the sensor when user presses the switch 6; and activate the ejector pump 14 if the temperature of the fluid is within a temperature range suitable for drinking with month; the electronic processor is also configured to receive the fluid status data from the sensor when presses the switch; and activate the ejector pump if there is fluid in the cup; an electronic display panel 51 installed on the outer wall of the cup, the electronic display panel is configured with the electronic processor and displays a message (52 and 53) when the fluid is beyond the temperature range or no fluid is in the cup, and under such conditions the ejector pump is configured not to be activated.

Still an optional lighting illumination in a plurality of formats and colors installed in the wall of the cup, the lighting illumination is configured to the electronic processor and the electrical wirings, serving as an indication of status of the fluid. The lighting illumination may also be configured to the electrical wirings, serving as an indication of operating status of the pump.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A fountain water cup comprising:

a cup in a plurality of hollow-cylindering shapes having a wall defining an interior configured to retain a fluid, the cup having an opening at a top portion and a closed end at a bottom portion;

a lid removably coupled to the opening of the cup at the top portion;

a first compartment housing an ejector pump, the first compartment having small openings configured as fluid inlets on its upper side, wherein the first compartment is located at a lower end of the cup;

a second compartment housing batteries, the second compartment located at the bottom portion of the cup;

a pipe having an ejection outlet connected to the ejector pump, the pipe extending from the first compartment through the interior of the cup to the top portion wherein the pipe is configured to connected to a second section of pipe positioned in the lid via connectors, and the ejector pump is configured to eject the fluid from the interior through the ejection outlet to a user such that the user is enabled to drink from the fountain water cup without physically contacting the fountain water cup preventing the transfer of germ, wherein the lid includes a fluid retaining compartment with a plurality of small openings serving as fluid inlets on an upper surface and wherein the lid includes a fluid outlet on an upper surface with a removable cover configured to release fluid retained in the fluid retaining compartment within the lid, the fluid retaining compartment configured to trap excessive fluid not drunk by a user and wherein the cup and the lid are configured to be fastened to each other to prevent the fluid from leaking.

2. A fountain water cup comprising:

a cup in a plurality of hollow-cylindering shapes having a wall defining an interior configured to retain a fluid, the cup having an opening at a top portion and a closed end at a bottom portion;

a lid removably coupled to the opening of the cup at the top portion;

a first compartment housing an ejector pump, the first compartment having small openings configured as fluid inlets on its upper side, wherein the first compartment is located at a lower end of the cup;

a second compartment housing batteries, the second compartment located at the bottom portion of the cup;

a pipe having an ejection outlet connected to the ejector pump, the pipe extending from the first compartment through the interior of the cup to the top portion wherein the pipe is configured to connected to a second section of pipe positioned in the lid via connectors, and the ejector pump is configured to eject the fluid from the interior through the ejection outlet to a user such that the user is enabled to drink from the fountain water cup without physically contacting the fountain water cup preventing the transfer of germ, an electronic monitoring device, the electronic monitoring device includes an electronic processor installed in the second compartment, a sensor installed in the first compartment; the electronic processor is further configured with a plurality of electrical wirings connecting an electrical switch and the ejector pump, wherein the electronic processor is configured to receive temperature data of the fluid from the sensor when user presses the switch and activate the ejector jump if the temperature of the fluid is within a temperature range suitable for drinking;

wherein the lid includes a fluid retaining compartment with a plurality of small openings serving as fluid inlets on an upper surface, the fluid retaining compartment configured to trap excessive fluid not drunk by a user.

3. The fountain water cup as recited in claim 2, wherein the electronic processor is configured to receive the fluid status data from the sensor when user presses the switch; and activate the ejector jump if there is fluid in the cup.

4. The fountain water cup as recited in claim 2, further comprising an electronic display panel installed on the outer wall of the cup, the electronic display panel is configured with the electronic processor and displays a message when the fluid is beyond the temperature range or no fluid is in the cup.

5. The fountain water cup as recited in claim 2, wherein a lighting illumination in a plurality of formats and colors installed on the wall of the cup, the lighting illumination is configured to the electronic processor and the electrical wirings functioning as an indication of status of the fluid.

* * * * *